US012196452B2

(12) United States Patent
Schumm et al.

(10) Patent No.: US 12,196,452 B2
(45) Date of Patent: Jan. 14, 2025

(54) FLOW HEATER WITH CORRUGATIONS

(71) Applicant: BorgWarner Ludwigsburg GmbH, Ludwigsburg (DE)

(72) Inventors: Sven Schumm, Walheim (DE); Mario Hoppe, Wendlingen am Neckar (DE); Yiqi Shi, Tianjin (CN); Yuchuan Shi, Ningbo (CN)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 692 days.

(21) Appl. No.: 17/474,875

(22) Filed: Sep. 14, 2021

(65) Prior Publication Data

US 2022/0082297 A1 Mar. 17, 2022

(30) Foreign Application Priority Data

Sep. 15, 2020 (DE) ..... 10 2020 123 996.3

(51) Int. Cl.
*F24H 1/10* (2022.01)
*F28F 1/42* (2006.01)

(52) U.S. Cl.
CPC ..... *F24H 1/102* (2013.01); *F28F 1/422* (2013.01); *F28F 2215/08* (2013.01)

(58) Field of Classification Search
CPC ..... B60H 1/2221; B60H 2001/2278; F24H 1/009; F24H 1/121; F24H 1/142; H05B 2203/02; H05B 2203/021; H05B 3/82
See application file for complete search history.

(56) References Cited

U.S. PATENT DOCUMENTS

| | | | | |
|---|---|---|---|---|
| 7,290,595 | B2 | 11/2007 | Morishita et al. | |
| 10,889,164 | B2 | 1/2021 | McCarthy et al. | |
| 2007/0095515 | A1* | 5/2007 | Morishita | F28F 3/027 165/109.1 |
| 2019/0077224 | A1 | 3/2019 | McCarthy et al. | |
| 2021/0254907 | A1* | 8/2021 | Nita | F28D 9/005 |

FOREIGN PATENT DOCUMENTS

| | | | |
|---|---|---|---|
| DE | 60 2004 007 251 | T2 | 3/2008 |
| DE | 10 2017 121 341 | B4 | 9/2019 |
| DE | 10 2018 108 407 | A1 | 10/2019 |
| GB | 2 059 042 | A | 4/1981 |

OTHER PUBLICATIONS

Antrag, DE 102018008511 (Year: 2020).*
Ueno, JP 2010133656 (Year: 2010).*

* cited by examiner

*Primary Examiner* — Vy T Ngyuen
(74) *Attorney, Agent, or Firm* — Bose, McKinney & Evans LLP

(57) ABSTRACT

A flow heater is described that has a housing in which a flow channel extends from a liquid inlet to a liquid outlet. The heater has a metal plate along which the flow channel runs, and the metal plate carries a heating resistor. Provision is made for the metal plate to carry a corrugated sheet that protrudes into the flow channel and has openings through which the liquid that is to be heated can pass.

10 Claims, 3 Drawing Sheets

FLOW HEATER WITH CORRUGATIONS

RELATED APPLICATIONS

This application claims priority to DE 10 2020 123 996.3, filed Sep. 15, 2020, the entire disclosure of which is hereby incorporated herein by reference.

BACKGROUND AND SUMMARY

This disclosure refers to a flow heater of the type generally known from DE 10 2017 121 341 B4.

Flow heaters are needed, for example, in automobiles to heat various liquids, in particular water or aqueous solutions. Constant objectives in the development of flow heaters for automobiles are a compact design, low manufacturing costs, and a high efficiency, such that a large amount of liquid can be heated in a short time.

This disclosure teaches a flow heater that achieves these objectives to an even greater extent.

In a flow heater according to this disclosure, a corrugated sheet is attached to a metal plate that carries an electrical heating resistor, for example a resistive layer, the ridges of which plate protrude into a flow channel of the liquid that is to be heated. The corrugated sheet has openings, through which the liquid that is to be heated can pass. The liquid that is to be heated therefore flows in the flow channel, both between the metal plate and the corrugated sheet, that is to say, within the ridges of the corrugated sheet, and also on the side of the corrugated sheet facing away from the metal plate, i.e., in the furrows of the corrugated sheet. In this way, the heat removal from the metal plate can be significantly improved, and thus a greater efficiency with a higher power density can be achieved.

The openings in the corrugated sheet allow an interchange between the liquid below and above the corrugated sheet. In addition, in the event of overheating, the openings prevent water vapor from accumulating under a ridge of the corrugated sheet. This is advantageous as water vapor would thermally insulate the metal plate from the liquid to be heated.

The corrugated sheet may have a sinusoidal cross-section. In other embodiments, the corrugated sheet may have an angular cross-section in which the ridges have flat side walls that extend from a flat furrow. In this way, a good thermal coupling of the corrugated sheet to the metal plate can be achieved in the furrows.

In an advantageous development, provision is made for the metal plate to be made of steel and the corrugated sheet to be made of an aluminium-based alloy, that is to say, an alloy that contains predominantly aluminium, for example, of at least 80% aluminium by weight, or more. The corrugated sheet can, for example, be attached to the metal plate by means of brazing. Openings in the corrugated sheet increase its flexibility, so that mechanical stresses that may arise in the course of temperature alterations, on account of different thermal expansion coefficients, can be compensated for more easily.

In a further advantageous refinement, provision is made for the openings to be arranged in the peaks of the ridges facing away from the metal plate. In the event of overheating, water vapor can in this way be removed from the metal plate particularly rapidly.

In a further advantageous refinement, provision is made for the density of the openings in an initial section of the flow channel to be greater than in a central section of the flow channel. When liquid that is to be heated reaches the metal plate, it can then divide particularly rapidly into one part flowing between the metal plate and the corrugated sheet, that is to say, within the ridges, and one part flowing along the part of the corrugated sheet facing away from the metal plate, that is to say, in the furrows. In a central section of the flow channel, on the other hand, a lower openings density is advantageous, for example an openings density that is only half as large, or less. Here the openings density is understood to be the quotient of the surface area of the openings and the total surface area.

In a further advantageous refinement, provision is made for the density of the openings in an end section of the flow channel to be greater than in a central section of the flow channel. In this way, the two component flows of liquid, flowing above and below the corrugated sheet, can be rapidly and efficiently recombined.

In a further advantageous refinement, provision is made for the density of the openings in an initial section of the flow channel to be greater than that in a central section of the flow channel.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
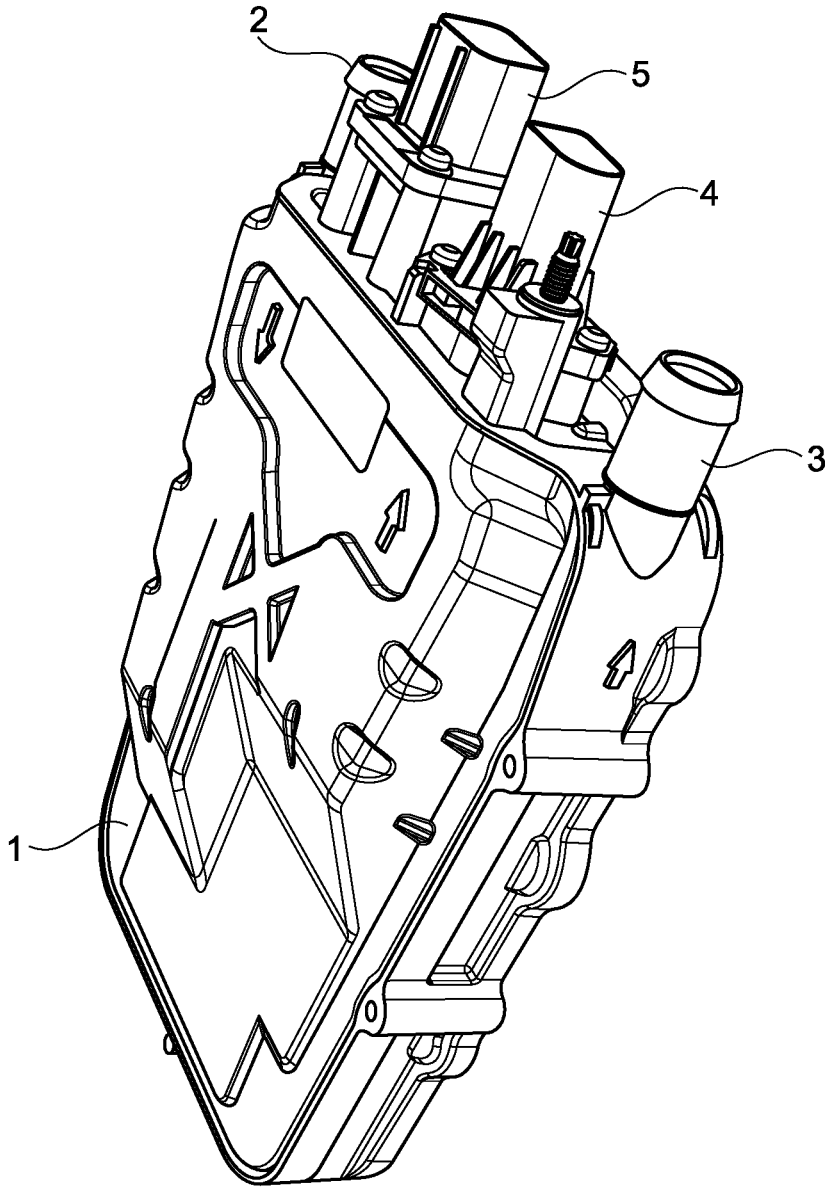
FIG. 1 shows an example of an instantaneous liquid heater.
Figure 2:
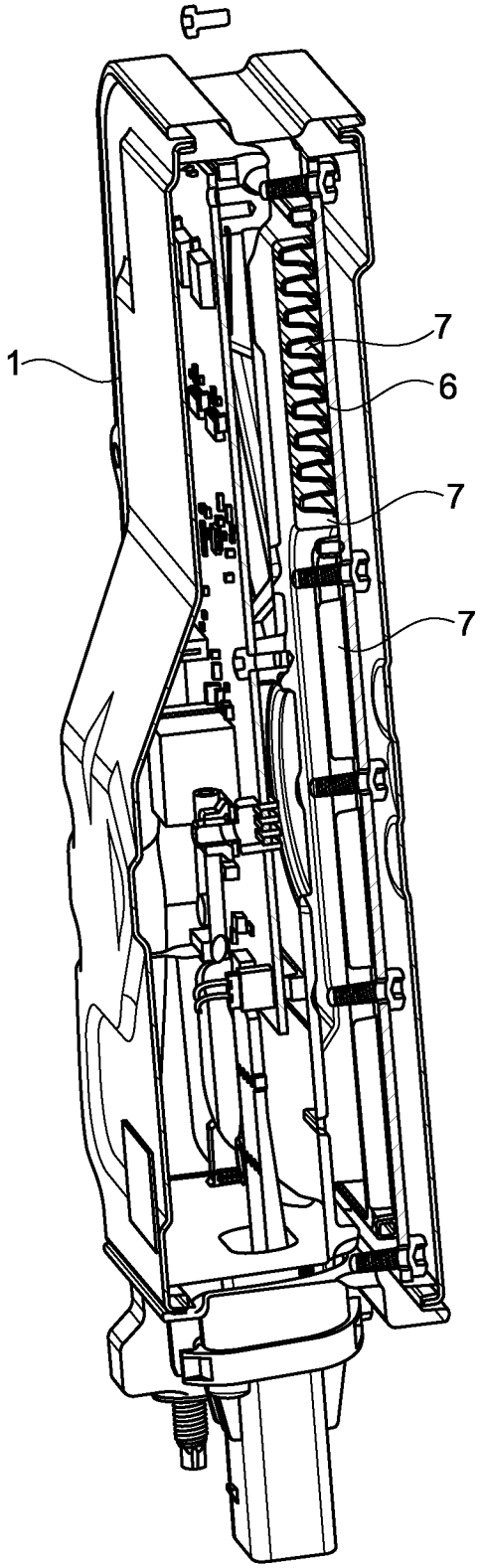
FIG. 2 shows a cross-sectional view through FIG. 1.

The flow heater shown in FIGS. 1 and 2 has a housing 1 with an inlet 2 and an outlet 3 as well as electrical connectors 4, 5. A flow channel for the liquid that is to be heated extends in the housing 1 from the inlet 2 to the outlet 3.

The flow channel runs along a metal plate 6, which carries one or a plurality of electrical heating resistors, for example in the form of conductive tracks. In order to improve heat dissipation to the liquid in the flow channel, the metal plate 6 carries at least one corrugated sheet 7, which protrudes into the flow channel.

Figure 3:
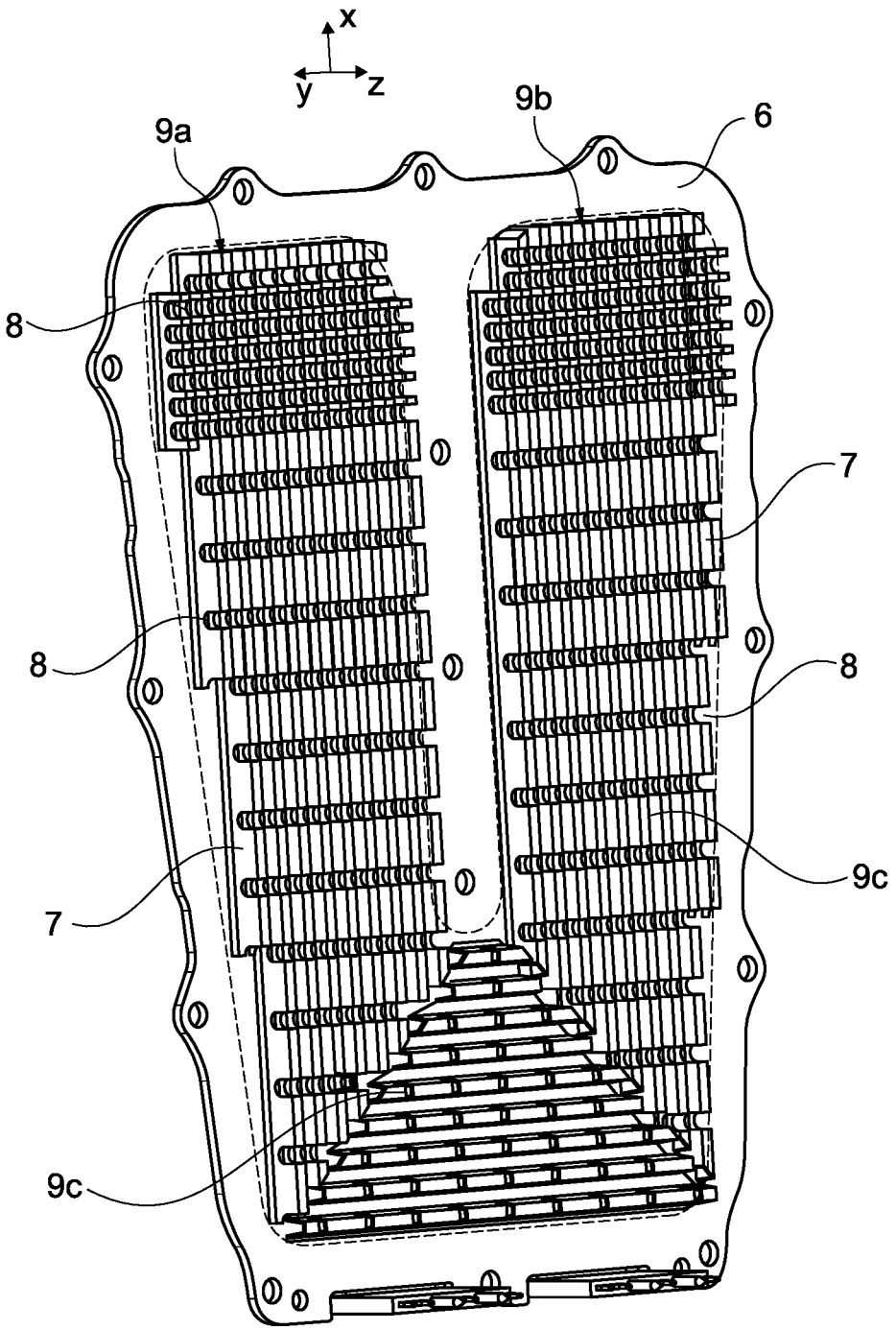
FIG. 3 shows an example of a heating plate of the instantaneous liquid heater.

FIG. 3 shows an example of embodiment of such a metal plate 6 with corrugated sheets 7. As can be seen, the corrugated sheets 7 have a plurality of openings 8, through which the liquid that is to be heated can pass. In the flow channel, the liquid that is to be heated therefore flows both between the metal plate 6 and the corrugated sheets (that is to say, under the ridges of the corrugations), and also on the side of the corrugations facing away from the metal plate 6 (that is to say, in the furrows of the corrugations). Here, in the event of overheating, the openings 8 also prevent water vapor from accumulating under a ridge of the corrugated sheet 7 and thereby thermally insulating the metal plate 6.

In the example of embodiment shown, the flow channel has a U-shaped profile. The density of the openings is increased at both ends of the flow channel. FIG. 3 shows, accordingly, an initial section 9*a*, and an end section 9*b*, of the flow channel, in which the density of openings is increased, compared to that of a central section 9*c*. The increased openings density in the initial section 9*a* makes it easier to divide a liquid flow entering the flow channel into one flow component flowing between the metal plate 6 and the corrugated sheets 7, and another flow component flowing on the side of the corrugated sheets 7 facing away from the metal plate 6. In a similar manner, the increased openings density in the end section 9*b* makes it easier to combine the two flow components. In the central section 9*c*, a few openings 8 are sufficient to prevent any gas bubbles that may form from accumulating between the metal plate 6 and the corrugated sheet 7.

In the embodiment shown, all openings 8 have the same size within manufacturing tolerances. However, it is also possible to achieve an increased openings density in the initial section 9*a*, and/or the end section 9*b*, by using larger openings instead of increasing their number per unit surface area. In the initial section 9*a* and the end section 9*b*, the distance between openings 8 may be smaller than the width of the openings 8, measured in the longitudinal direction of the corrugations. In the central section 9*c*, the distance between openings 8 is larger than the width of the openings 8, measured in the longitudinal direction of the corrugations.

The openings 8 are in each case arranged in the peaks of the ridges of the corrugations facing away from the metal plate 6. In this way, any gas bubbles can escape particularly rapidly from the spaces between the metal plate 6 and the corrugated sheets 7. Each ridge of the corrugations has a plurality of openings 8.

The metal plate 6 is, for example, a steel sheet. The corrugated sheets 7 can, for example, be made of an aluminium-based alloy, and brazed to the metal plate 6. In order not to weaken the bonding between the metal plate 6 and the corrugated sheet 7, the furrows of the corrugated sheets adjacent to the metal plate 6 are free of openings.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Housing
2 Inlet
3 Outlet
4 Connector
5 Connector
6 Metal plate
7 Corrugated sheet
8 Opening
9*a* Initial section
9*b* End section
9*c* Central section

What is claimed is:

1. A flow heater, comprising:
a housing having an inlet and an outlet;
a flow channel extending from the inlet to the outlet;
a metal plate along which the flow channel runs;
an electrical heating resistor carried by the metal plate; and
a corrugated sheet carried by the metal plate, wherein the corrugated sheet protrudes into the flow channel and has openings through which the liquid that is to be heated can pass;
wherein a distance between adjacent ridges of the corrugated sheet in an initial section of the flow channel is less than a distance between adjacent ridges of the corrugated sheet in a central section of the flow channel.

2. The flow heater according to claim 1, wherein the openings are formed in peaks of the ridges of the corrugated sheet, facing away from the metal plate.

3. The flow heater according to claim 1, wherein each ridge of the corrugated sheet has at least one of the openings.

4. The flow heater according to claim 1, wherein a density of the openings in the initial section of the flow channel is greater than a density of the openings in the central section of the flow channel.

5. The flow heater according to claim 1, wherein a density of the openings in an end section of the flow channel is higher than a density of the openings in the central section of the flow channel.

6. The flow heater according to claim 1, wherein in the initial section and/or an end section of the flow channel, the openings that are cut into the ridges of the corrugated sheet have a greater width, measured in the longitudinal direction of the ridges, than a distance from the edge of one opening to an adjacent opening of the same ridge.

7. The flow heater according to claim 1, wherein the metal plate is made of steel and the corrugated sheet is made of an aluminum-based alloy wherein the surface of the steel plate is brazed to a corresponding surface of the corrugated sheet.

8. The flow heater according to claim 1, wherein furrows of the corrugated sheet adjacent to the metal plate are free of openings.

9. The flow heater according to claim 1, wherein the corrugated sheet comprises a plurality of corrugated sheets carried by the metal plate.

10. A flow heater, comprising:
a housing having an inlet and an outlet
a flow channel extending from the inlet to the outlet;
a metal plate along which the flow channel runs;
an electrical heating resistor carried by the metal plate; and
a corrugated sheet carried by the metal plate, wherein the corrugated sheet protrudes into the flow channel and has openings through which the liquid that is to be heated can pass;
wherein a distance between adjacent ridges of the corrugated sheet in an end section of the flow channel is less than a distance between adjacent ridges of the corrugated sheet in a central section of the flow channel.

* * * * *